US006039022A

United States Patent [19]

Meistrick et al.

[11] Patent Number: 6,039,022

[45] Date of Patent: Mar. 21, 2000

[54] CO-AXIAL MASTER PISTON ASSEMBLY

[75] Inventors: Zdenek Meistrick, Bloomfield; Vincent Pitzi, South Windsor, both of Conn.

[73] Assignee: Diesel Engine Retardes, Inc., Wilmington, Del.

[21] Appl. No.: 09/161,832

[22] Filed: Sep. 29, 1998

Related U.S. Application Data

[60] Provisional application No. 60/060,657, Oct. 2, 1997.

[51] Int. Cl.[7] ..... F02D 13/04; F01L 9/02

[52] U.S. Cl. ..... 123/321; 123/90.12

[58] Field of Search ..... 123/321, 323, 123/324, 90.12, 90.16

[56] References Cited

U.S. PATENT DOCUMENTS

| | | | |
|---|---|---|---|
| 4,706,625 | 11/1987 | Meistrick et al. | 123/321 |
| 5,048,480 | 9/1991 | Price | 123/321 |
| 5,183,018 | 2/1993 | Vittorio et al. | 123/321 |
| 5,406,918 | 4/1995 | Joko et al. | 123/321 |
| 5,462,025 | 10/1995 | Israel et al. | 123/321 |
| 5,485,819 | 1/1996 | Joko et al. | 123/321 |
| 5,645,031 | 7/1997 | Meneely | 123/322 |
| 5,680,841 | 10/1997 | Hu | 123/322 |
| 5,787,859 | 8/1998 | Meistrick et al. | 123/321 |
| 5,809,964 | 9/1998 | Meistrick et al. | 123/321 |
| 5,829,397 | 11/1998 | Vorih et al. | 123/90.12 |

*Primary Examiner*—Thomas N. Moulis
*Assistant Examiner*—Mahmoud M. Gimie
*Attorney, Agent, or Firm*—Collier, Shannon, Rill & Scott, PLLC

[57] ABSTRACT

The present invention relates to a co-axial master piston for use in providing hydraulic fluid to effectuate a compression release braking function and hydraulic fluid to effectuate an exhaust gas recirculation function. In particular, the coaxial master piston includes an inner master piston driven by an exhaust cam to provide the hydraulic force to cause the compression release braking function. An outer piston, driven by the same exhaust cam, provides the hydraulic force to cause the EGR function during positive power operation of the engine and during compression release braking when required.

20 Claims, 2 Drawing Sheets

CO-AXIAL MASTER PISTON ASSEMBLY

CROSS REFERENCE TO RELATED PATENT APPLICATION

This application relates to and claims priority on provisional application Ser. No. 60/060,657, entitled "TANDEM CO-AXIAL MASTER PISTON," filed Oct. 2, 1997.

FIELD OF THE INVENTION

The present invention relates to a co-axial master piston for use in providing hydraulic fluid to effectuate a compression release braking ("CRB") function and hydraulic fluid to effectuate an exhaust gas recirculation ("EGR") function. In particular, the coaxial master piston includes an inner master piston driven by an engine component to provide the hydraulic force to cause the compression release braking function. An outer piston, driven by the same engine component, provides the hydraulic force to cause the EGR function during positive power operation of the engine and during compression release braking when required.

OBJECTS OF THE INVENTION

It is therefore an object of the present invention to provide a co-axial master piston that is capable of providing hydraulic fluid to effectuate both a compression release braking function and an EGR function.

It is another object of the present invention to provide a co-axial master piston that is capable of providing hydraulic fluid to effectuate a compression release braking function for a cylinder and hydraulic fluid to effectuate an EGR for another cylinder.

SUMMARY OF THE INVENTION

The present invention is directed to a system for providing exhaust gas recirculation and compression release braking in an engine. The system includes a compression release retarding assembly for opening a first valve assembly to perform a compression release retarding operation. The system also includes an exhaust gas recirculation assembly for opening a second valve assembly to perform an exhaust gas recirculation operation. The system also includes an energy deriving assembly for deriving energy from an engine component. The energy deriving assembly supplies energy to the compression release retarding assembly and the exhaust gas recirculation assembly. The compression release retarding assembly is capable of operating the first valve assembly from energy derived from the energy deriving assembly. The exhaust gas recirculation assembly is capable of operating the second valve assembly from energy derived from the energy deriving assembly.

In accordance with the present invention, each of the first valve assembly and the second valve assembly may include at least one exhaust valve. The compression release retarding assembly controls the opening of the at least one exhaust valve of the first valve assembly for one engine cylinder. The exhaust gas recirculation assembly controls the opening of the at least one exhaust valve of the second valve assembly for another engine cylinder.

In accordance with the present invention, the energy deriving assembly includes a housing having a passageway. The energy deriving assembly may include a first energy supply assembly for supplying energy derived from the engine component to the compression release retarding assembly. The energy deriving assembly may further include a second energy supply assembly for supplying energy derived from the engine component to the exhaust gas recirculation assembly.

The first energy supply assembly may include a first piston assembly that is movably mounted within the passageway in the housing. The first energy supply assembly may further include a first transfer assembly for transferring motion of the first piston assembly to the compression release retarding system. The first transfer assembly may include a first passageway which is interconnected with the passageway.

The second energy supply assembly may include a second piston assembly that is movably mounted within the passageway in the housing. The second energy supply assembly may further include a second transfer assembly for transferring motion of the first piston assembly to the compression release retarding system. The second transfer assembly may include a second passageway, which is interconnected with the passageway.

The first piston assembly may be an inner piston assembly and the second piston assembly may be an outer piston assembly. In accordance with one embodiment of the present invention, the inner piston assembly may be slidably received within a portion of the outer piston assembly. The system may further include a biasing assembly for biasing the inner piston assembly within the passageway. The biasing assembly may bias the inner piston assembly to an off position during an exhaust gas recirculation event.

The present invention is also directed to a coaxial master piston. The coaxial master piston includes a housing, a first piston assembly movably mounted within the housing, and a second piston assembly movably mounted within the housing. The first piston assembly may be an inner piston assembly and the second piston assembly may be an outer piston assembly. In accordance with an embodiment of the present invention, the inner piston assembly may be slidably received within a portion of the outer piston assembly. The master piston may further include a biasing assembly for biasing the inner piston assembly within the housing.

BRIEF DESCRIPTION OF THE DRAWINGS

The invention will be described in conjunction with the following drawings in which like reference numerals designate like elements and wherein.

DETAILED DESCRIPTION OF THE INVENTION

Figure 1:
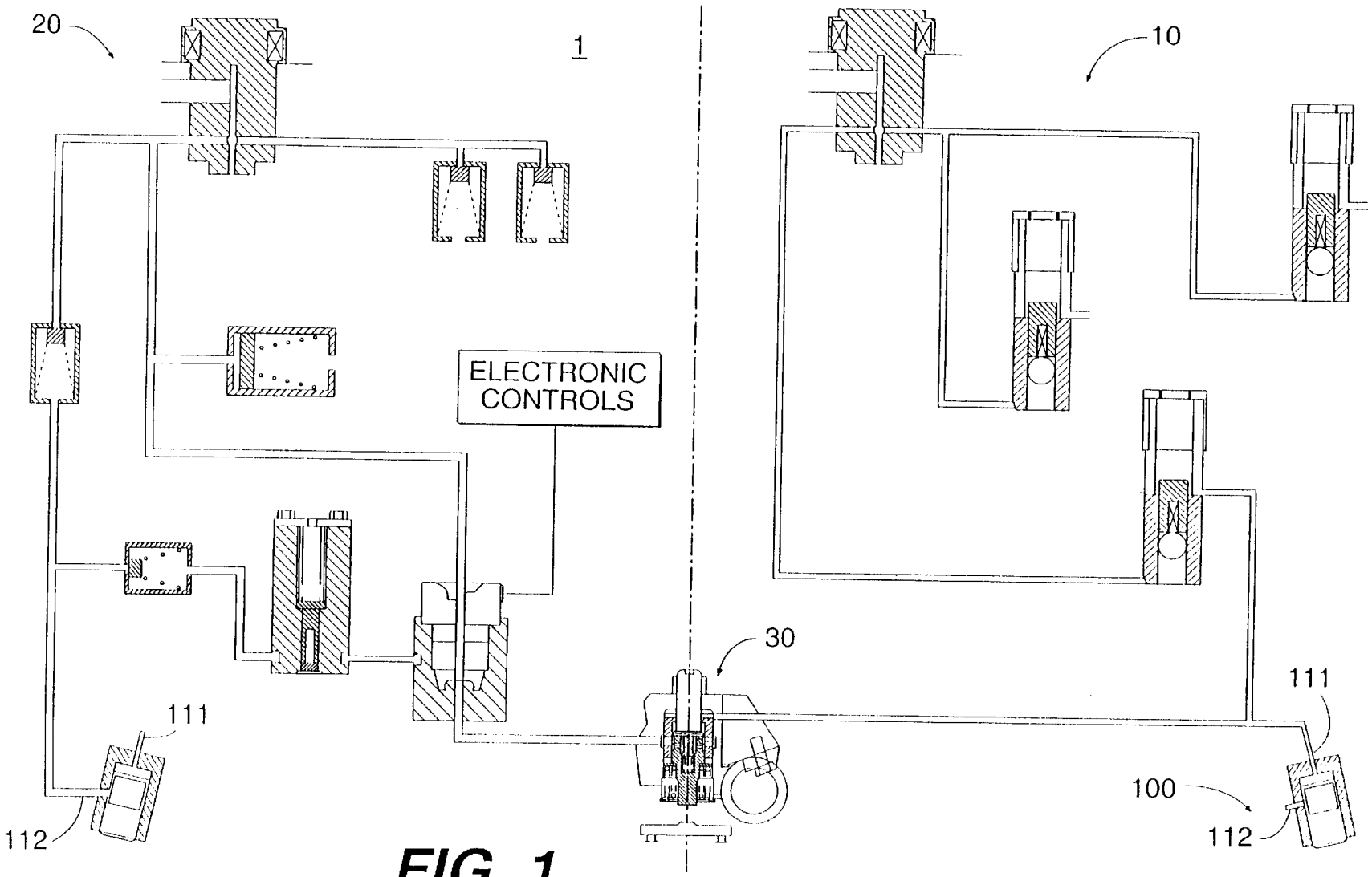
FIG. 1 is a schematic diagram of a combined EGR and compression release retarding system incorporating a co-axial master piston according to the present invention.

For purpose of illustration, the present invention will be described for use in a six (6) cylinder in-line engine. The co-axial master piston assembly 100 is capable of being used in combined system 1 having a compression release retarding system 10 and an EGR system 20, as shown in FIG. 1.

The compression release retarding system 10 is a compression release system such as a traditional Jacobs engine brake for actuating an exhaust valve of a cylinder on a compression stroke. As embodied herein, compression release retarding system 10 could, alternatively, comprise a "common rail" compression release engine retarder. The compression release retarding system 10 includes an energy deriving assembly 100; a valve actuation assembly or slave piston 30; and an assembly for transferring energy from the energy deriving assembly 100 to the valve actuation assembly 30, as depicted in FIG. 1. As embodied herein, the energy deriving assembly is a co-axial master piston 100 cooperates with energy transfer assembly, by supplying input in the form of either motion or energy, which cooperates with valve actuation assembly 30, which opens at least one exhaust valve.

The EGR system 20 is a system for actuating an exhaust valve of a cylinder. Unlike the compression release event, which occurs near top dead center compression, the exhaust gas recirculation event occurs during intake or at the beginning of the compression stroke. The EGR system 20 includes a co-axial master piston 100, a valve actuation assembly or slave piston 30, and an transfer assembly. As embodied herein, the co-axial master piston 100 cooperates with transfer assembly, by supplying input in the form of either motion or energy, the transfer assembly cooperates with the valve actuation assembly 30, which opens at least one exhaust valve in an engine cylinder.

Figure 3:
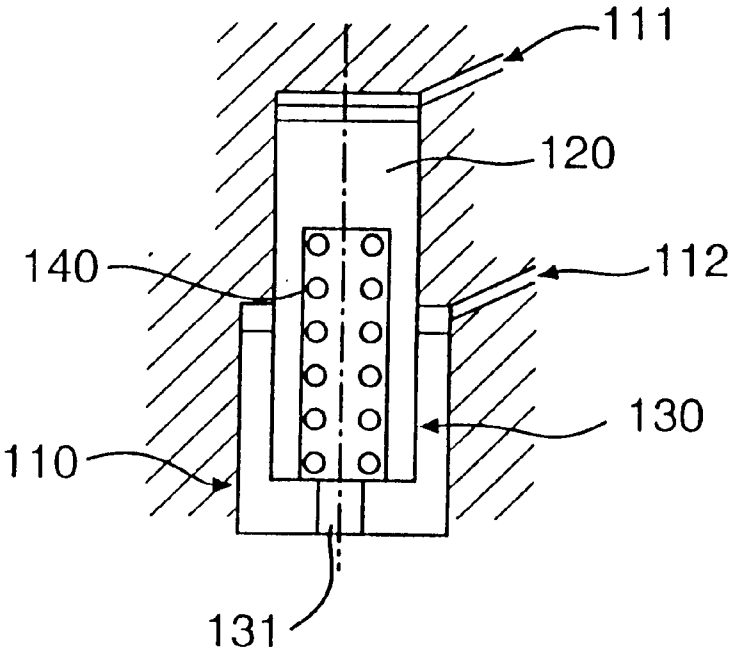
FIG. 3 is an optional schematic diagram of the co-axial master piston of FIG. 2.
Figure 2:
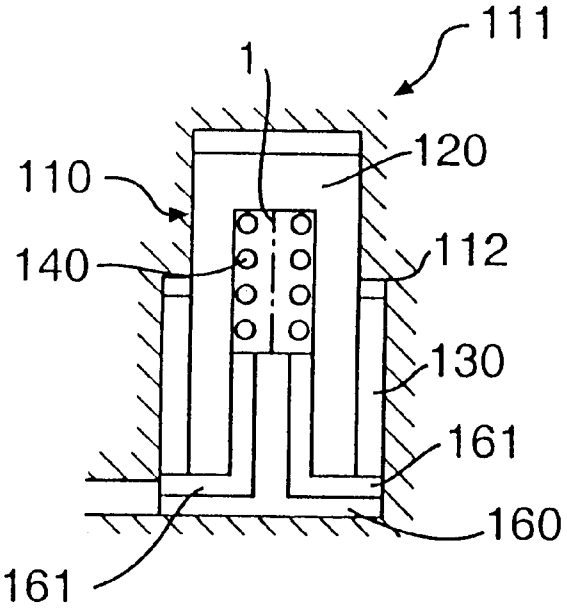
FIG. 2 is a schematic diagram of the co-axial master piston according to the present invention.

The co-axial master piston 100 has a housing 110. The housing 110 has a passageway 113, as shown in FIGS. 2 and 3. Located within the passageway 113 in the housing 110 is first energy supply assembly 120 for supplying energy derived from the engine component to the compression release retarding assembly 10. The first energy supply assembly is preferably an inner piston 120. A second energy supply assembly 130 for supplying energy derived from the engine component to the exhaust gas recirculation system 20. The second energy supply assembly is preferably an outer piston 130. The outer piston 130 may include a drainage passageway 131 to permit leakage between the inner piston 120 and outer piston 130. The inner piston 120 is operated to effectuate a compression release retarding event. Hydraulic fluid is forced through an aperture 111 in the upper portion of the co-axial master piston housing 110. When the EGR circuit is OFF, leakage from the CRB circuit to the EGR circuit through aperture 112 is pumped to delay piston and eventually dumped to drain by an overtravel protection vent. The outer piston 130 may incorporate the end cap 160, as shown in FIG. 2. The end cap 160 may include at least one vent groove 161 formed therein to permit leakage between the inner piston 120 and outer piston 130, as shown in FIG. 2.

During an EGR event during positive power, the inner piston 120 is held in an "OFF" position by an inner spring 140. The hydraulic circuit is open to drain during EGR Operation of only the outer piston 130 supplies hydraulic fluid to effectuate an EGR event Hydraulic fluid is forced through an EGR aperture 112. The EGR aperture 112 may be positioned in the sidewall of the co-axial master piston housing 110.

A suitable control assembly linked to engine and vehicle controls is provided to control the operation of the inner and outer pistons 120 and 130 to effectuate the compression release retarding event and an EGR event. A vent may be provided to drain off leakage between the inner and outer pistons. Additionally, the compression release retarding function and the exhaust gas recirculation function can function independently or together.

If an exhaust cam is selected as a source of energy for the transfer piston with engine having a firing order 1-5-3-6-2-4, Table 1 illustrates an example the correspondence between the coaxial master piston 100 for each cylinder according to the present invention and the associated valve actuation assembly for opening the exhaust valve during exhaust gas recirculation.

TABLE 1

Exhaust Gas Recirculation

| Master Piston | Valve actuation assembly |
|---|---|
| Cylinder 1 | Cylinder 1 |
| Cylinder 2 | Cylinder 2 |
| Cylinder 3 | Cylinder 3 |
| Cylinder 4 | Cylinder 4 |
| Cylinder 5 | Cylinder 5 |
| Cylinder 6 | Cylinder 6 |

Table 2 illustrates the correspondence between the coaxial master piston 100 for each cylinder according to the present invention and the associated valve actuation assembly to cause a compression release braking function.

TABLE 2

Compression Release Retarding

| Master Piston | Valve actuation assembly |
|---|---|
| Cylinder 1 | Cylinder 2 |
| Cylinder 2 | Cylinder 3 |
| Cylinder 3 | Cylinder 1 |
| Cylinder 4 | Cylinder 6 |
| Cylinder 5 | Cylinder 4 |
| Cylinder 6 | Cylinder 5 |

It will be apparent to those skilled in the arts that various modifications and variations can be made in the construction and configuration of the present invention, without departing from the scope or spirit of the invention. Several variations have been discussed in the preceding text. Others will be apparent to persons of ordinary skills in the art For example, the illustrative embodiment has been described with reference to an in-line six (6) cylinder engine. The number of cylinders (1, 4, 8, 10 or any other number of cylinders), the configuration (V, straight or other), aspiration (natural or turbocharged), cooling (air or water), or other basic engine parameters can all be varied. In addition, although the invention has been described with reference to a single valve, any number of valves can be opened in the cylinder consistent with the present invention.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A system for providing exhaust gas recirculation and compression release braking in an engine, said system comprising:

a compression release retarding assembly for opening a first valve assembly to perform a compression release retarding operation;

an exhaust gas recirculation assembly for opening a second valve assembly to perform an exhaust gas recirculation operation; and energy deriving means for deriving energy from an engine component to supply energy to said compression release retarding assembly and said exhaust gas recirculation assembly, wherein said compression release retarding assembly is capable of operating said first valve assembly from energy derived from said energy deriving means, and said exhaust gas recirculation assembly is capable of operating said second valve assembly from energy derived from said energy deriving means.

2. The system according to claim 1, wherein each of said first valve assembly and said second valve assembly includes at least one exhaust valve.

3. The system according to claim 2, wherein said compression release retarding assembly controls the opening of said at least one exhaust valve of said first valve assembly for an engine cylinder, and said exhaust gas recirculation assembly controls the opening of said at least one exhaust valve of said second valve assembly for another engine cylinder.

4. The system according to claim 1, wherein said energy deriving means comprises:

first energy supply means for supplying energy derived from the engine component to said compression release retarding assembly; and second energy supply means for supplying energy derived from the engine component to said exhaust gas recirculation assembly.

5. The system according to claim 4, wherein said energy deriving means further includes a housing having a primary passageway.

6. The system according to claim 5, wherein said first energy supply means comprises:

a first piston assembly movably mounted within said primary passageway in said housing; and first transfer means for transferring motion of said first piston assembly to said compression release retarding assembly.

7. The system according to claim 6, wherein said first transfer means includes a first passageway, said first passageway being interconnected with said primary passageway.

8. The system according to claim 6, wherein said second energy supply means comprises:

a second piston assembly movably mounted within said primary passageway in said housing; and second transfer means for transferring motion of said first piston assembly to said compression release retarding system.

9. The system according to claim 8, wherein said second transfer means includes a second passageway, said second passageway being interconnected with said primary passageway.

10. The system according to claim 8, wherein said first piston assembly is an inner piston assembly and said second piston assembly is an outer piston assembly.

11. The system according to claim 10, wherein said inner piston assembly is slidably received within a portion of said outer piston assembly.

12. The system according to claim 11, further comprising:

biasing means for biasing said inner piston assembly within said primary passageway.

13. The system according to claim 12, wherein said biasing means biases said inner piston assembly to an off position during an exhaust gas recirculation event.

14. A coaxial master piston comprising:

a housing;

a first piston assembly movably mounted within said housing, wherein said first piston assembly is operably connected to a first assembly for operating a first valve assembly; and a second piston assembly movably mounted within said housing, wherein said second piston assembly is operably connected to a second assembly for operating a second valve assembly.

15. The master piston according to claim 14, wherein said first piston assembly is an inner piston assembly and said second piston assembly is an outer piston assembly.

16. The master piston according to claim 15, wherein said inner piston assembly is slidably received within a portion of said outer piston assembly.

17. The master piston according to claim 16, further comprising:

biasing means for biasing said inner piston assembly within said housing.

18. The master piston according to claim 14, wherein said housing includes a primary passageway, and first and second piston assemblies being movably mounted within said primary passageway.

19. The master piston according to claim 18, wherein said first piston assembly is an inner piston assembly and said second piston assembly is an outer piston assembly, wherein said inner piston assembly is slidably received within a portion of said outer piston assembly within said primary passageway.

20. The master piston according to claim 14, wherein said first assembly opens said first valve assembly to perform a compression release retarding operation, and said second assembly opens said second valve assembly to perform an exhaust gas recirculation operation.

* * * * *